US012084869B2

(12) United States Patent
Merrick et al.

(10) Patent No.: US 12,084,869 B2
(45) Date of Patent: Sep. 10, 2024

(54) SELF-SPACING LAP SIDING PRODUCT

(71) Applicant: LOUISIANA-PACIFIC CORPORATION, Nashville, TN (US)

(72) Inventors: Paul Merrick, Gig Harbor, WA (US); Larry Lampart, Two Harbors, MN (US); Lance Olson, Saginaw, MN (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 248 days.

(21) Appl. No.: 17/510,555

(22) Filed: Oct. 26, 2021

(65) Prior Publication Data

US 2022/0042319 A1 Feb. 10, 2022

Related U.S. Application Data

(63) Continuation-in-part of application No. 16/858,870, filed on Apr. 27, 2020, now Pat. No. 11,156,002, which is a continuation-in-part of application No. 16/775,010, filed on Jan. 28, 2020, now Pat. No. 11,225,799, which is a continuation-in-part of application No. 15/956,562, filed on Apr. 18, 2018, now Pat. No. 10,544,594, application No. 17/510,555 is a continuation-in-part of application No. 16/775,010, filed on Jan. 28, 2020, now Pat. No. 11,225,799, which is a continuation-in-part of application No. 15/956,562, filed on Apr. 18, 2018, now Pat. No. 10,544,594.

(51) Int. Cl.

| | |
|---|---|
| ***E04D 1/00*** | (2006.01) |
| ***E04F 13/08*** | (2006.01) |
| *E04F 13/10* | (2006.01) |
| *E04F 13/14* | (2006.01) |

(52) U.S. Cl.
CPC ..... *E04F 13/0892* (2013.01); *E04F 13/10* (2013.01); *E04F 13/14* (2013.01)

(58) Field of Classification Search
CPC ..... E04F 13/0892; E04F 13/10; E04F 13/14
See application file for complete search history.

(56) References Cited

U.S. PATENT DOCUMENTS 1,463,041 A * 7/1923 Kalin ..... E04F 13/10 52/716.1
1,971,010 A * 8/1934 Korn ..... E04F 13/10 52/541

(Continued)

*Primary Examiner* — Basil S Katcheves
(74) *Attorney, Agent, or Firm* — Wayne Edward Ramage; Baker Donelson

(57) ABSTRACT

A lap siding product with a unique shiplap joint that spaces abutting pieces of siding correctly from each other without installer measurements. The shiplap joint comprises a bottom element and a top element. A lap siding panel or board has a bottom element shiplap joint at one end, and a top elements shiplap joint at the other end. The corresponding ends of two lap siding panels or boards (i.e., one bottom element and one top element) together form the unique shiplap joint of the present invention. One or more drainage channels or grooves help re-direct water from the joint, and at least one of the channels or grooves also provides a visual element for proper spacing. An engineered "stop" on the underside of the top element also helps space the pieces of siding correctly, without requiring measurement during installation.

13 Claims, 9 Drawing Sheets

(56) References Cited

U.S. PATENT DOCUMENTS 2,276,170 A * 3/1942 Elmendorf ..... E04F 13/0864 52/409
2,291,498 A * 7/1942 Odell ..... E04F 13/10 428/44
2,430,200 A * 11/1947 Wilson ..... E04F 15/04 52/538
2,835,932 A * 5/1958 Walton ..... E04F 13/10 52/560
2,872,712 A * 2/1959 Brown ..... E04F 13/10 52/578
3,200,553 A * 8/1965 Frashour ..... E04F 15/04 52/592.4
4,351,694 A * 9/1982 Mathis ..... E04F 21/22 156/574
4,439,970 A * 4/1984 Rosner ..... E04F 13/0835 52/552
5,735,099 A * 4/1998 Anderson ..... E04F 13/10 52/592.4
5,755,068 A * 5/1998 Ormiston ..... E04F 15/02033 428/167
6,460,583 B1 * 10/2002 Lindal ..... B27M 3/0046 52/748.1
7,444,791 B1 * 11/2008 Pervan ..... E04F 15/02044 52/592.2
7,617,645 B2 * 11/2009 Moriau ..... E04F 15/02038 52/592.1
7,926,239 B2 * 4/2011 Hahn ..... E04F 15/02033 52/592.1
8,245,478 B2 * 8/2012 Bergelin ..... E04B 1/68 52/592.1
8,341,898 B1 * 1/2013 Mizia ..... E04F 13/0864 52/286
8,438,814 B2 * 5/2013 Thiers ..... E04F 15/04 52/390
8,495,849 B2 * 7/2013 Pervan ..... B27F 1/02 52/592.4
9,464,444 B2 * 10/2016 Engstrom ..... E04F 15/02038
10,544,594 B2 * 1/2020 Merrick ..... E04F 13/0889
11,225,799 B2 * 1/2022 Merrick ..... E04F 13/0889
2003/0014936 A1 * 1/2003 Watanabe ..... E04F 13/0864 52/553
2003/0143360 A1 * 7/2003 Dauplay ..... B32B 9/02 428/54
2004/0111993 A1 * 6/2004 Hollman ..... B27D 5/003 52/578
2005/0252170 A1 * 11/2005 Chiang ..... E04F 13/0862 52/796.1
2006/0053724 A1 * 3/2006 Braun ..... B32B 7/12 52/578
2006/0101768 A1 * 5/2006 Watson ..... B29C 48/12 52/578
2007/0028547 A1 * 2/2007 Grafenauer ..... E04F 13/10 52/586.1
2007/0261340 A1 * 11/2007 Cecilio ..... E04F 13/10 52/311.1
2008/0155928 A1 * 7/2008 Weiss ..... E04F 13/0864 52/748.1
2008/0295438 A1 * 12/2008 Knauseder ..... E04F 15/02 403/336
2010/0251655 A1 * 10/2010 Monteer ..... E04F 13/0841 52/309.3
2011/0280655 A1 * 11/2011 Maertens ..... F16B 12/46 403/375
2015/0059272 A1 * 3/2015 Husler ..... E04C 2/44 52/302.3
2016/0347084 A1 * 12/2016 Clement ..... E04F 13/10
2020/0232224 A1 * 7/2020 Merrick ..... E04F 13/0894
2020/0256062 A1 * 8/2020 Merrick ..... E04F 13/0889

* cited by examiner

SELF-SPACING LAP SIDING PRODUCT

This application is a continuation of U.S. patent application Ser. No. 16/858,870, filed Apr. 27, 2020, which is a continuation-in-part of U.S. patent application Ser. No. 16/775,010, filed Jan. 28, 2020, which is a continuation-in-part of U.S. patent application Ser. No. 15/956,562, filed Apr. 18, 2018, now U.S. Pat. No. 10,544,594, issued Jan. 28, 2020, which claims benefit of and priority to U.S. Provisional App. No. 62/486,506, filed Apr. 18, 2017, all of which are incorporated herein in their entireties by specific reference for all purposes. This application also is a continuation-in-part of U.S. patent application Ser. No. 16/775,010, filed Jan. 28, 2020, which is a continuation-in-part of U.S. patent application Ser. No. 15/956,562, filed Apr. 18, 2018, now U.S. Pat. No. 10,544,594, issued Jan. 28, 2020, which claims benefit of and priority to U.S. Provisional App. No. 62/486,506, filed Apr. 18, 2017.

FIELD OF INVENTION

This invention relates to a lap siding product with a unique shiplap joint that spaces abutting pieces of siding correctly from each other without installer measurements.

SUMMARY OF INVENTION

The length of horizontal cladding or siding expands and contracts due to changes in moisture content, temperature, and climate. This movement requires proper spacing of the cladding or siding material at the joints. Inconsistent or inaccurate spacing can lead to deflection or buckling.

In various exemplary embodiments, the present invention comprises a lap siding product with a unique shiplap joint that spaces abutting pieces of siding correctly from each other without installer measurements. The shiplap joint comprises a bottom element and a top element. A lap siding panel or board has a bottom element shiplap joint at one end, and a top elements shiplap joint at the other end. The corresponding ends of two lap siding panels or boards (i.e., one bottom element and one top element) together form the unique shiplap joint of the present invention. An engineered "stop" on the underside of the top element spaces the pieces of siding correctly, without requiring measurement during installation. This also eliminates the need for caulk, pan flashing or joint covers in the joint between the pieces of siding or cladding. The shape of the joint also reduces the intrusion of water, and re-directs water down and out from behind the siding.

DETAILED DESCRIPTION OF EXEMPLARY EMBODIMENTS

In various exemplary embodiments, as seen in FIGS. 1-5, the present invention comprises a lap siding product with a unique shiplap joint 10 that spaces abutting pieces of lap siding 2, 4 correctly from each other without measurements taken or needed by the installer. Each piece of lap siding comprises an outer face 100 and an inner face 110. The shiplap joint 10 comprises a bottom element 2*a* and a top element 4*a*, each extending from the respective piece of lap siding 2, 4. A piece of lap siding panel or board has a bottom element 2*a* for a shiplap joint at one end 2*b*, and a top element 4*a* for a shiplap joint at the other end 4*b*. The corresponding ends of two abutting lap siding panels or boards (i.e., one providing a bottom element, and the other providing a top element) together form the unique shiplap joint of the present invention.

Figure 3:
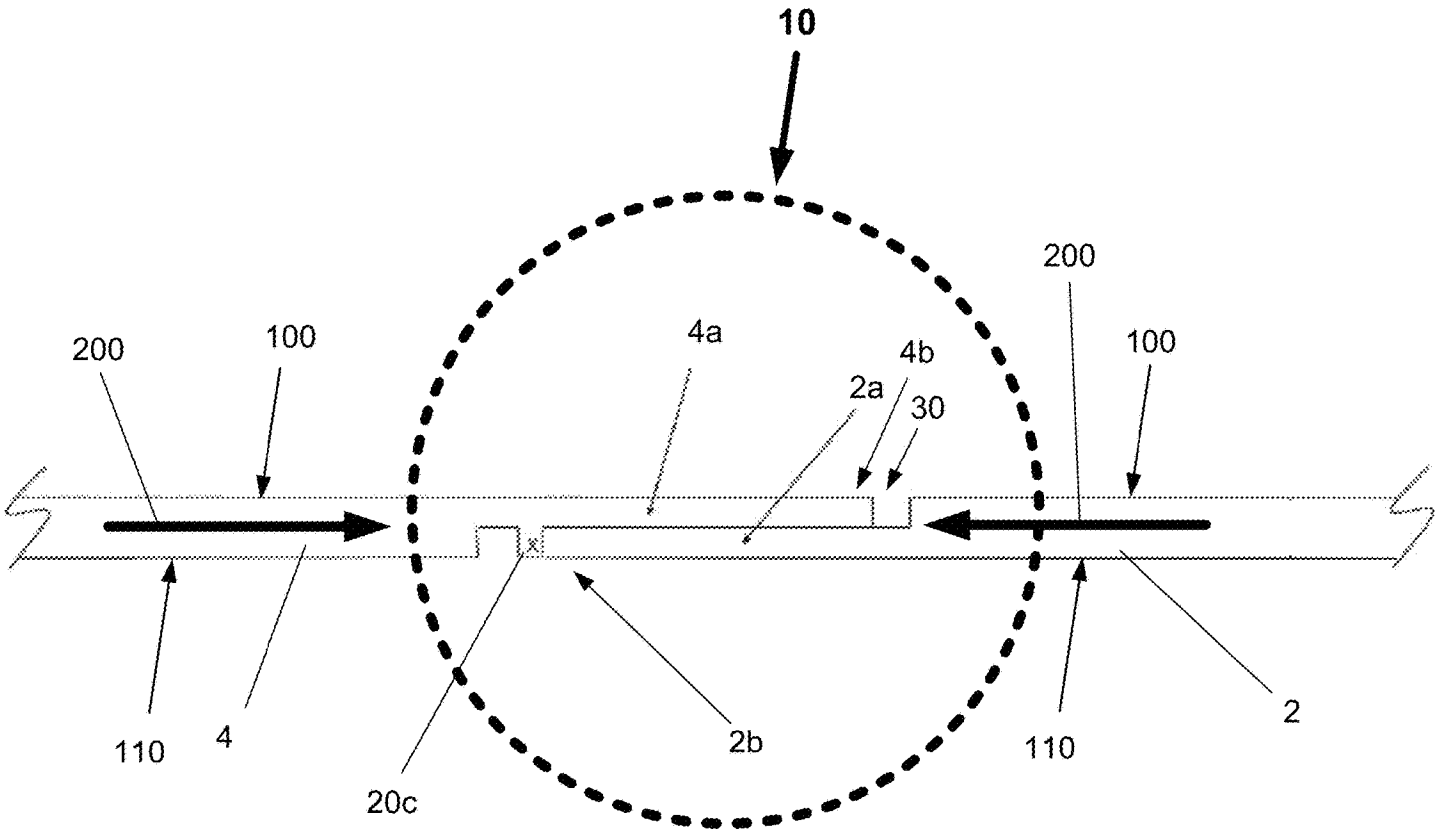
FIG. 3 shows yet another view of a lap siding product in accordance with another embodiment of the present invention.

A "stop" 20*a, b, c* is engineered on or adjacent to the underside of the top element 4*a* to spaces the pieces of siding 2, 4 correctly, without requiring measurement during installation. The "stop" may form an angled wedge or triangular section 20*a* (see FIG. 1) or a rectilinear section or tab 20*b* (see FIG. 2) extending from the lower portion of the lap siding in or near the corner with the top element. The stop element may extend longitudinally parallel to the underside (inner face) of the top shiplap joint element. The "stop" also may form a wedge, triangular or rectilinear section or tab 20*c* extending from the underside of the top element, as seen in FIG. 3. The stop element may extend perpendicularly from the top shiplap joint element. The stop may be a section of wood (or whatever material is used for the siding panels) cut-out, engineered, or otherwise integrated with the corresponding piece of siding, although in some embodiment, the stop may be added to the siding in the proper position.

The length or location of the "stop" serves as a stop point for the end 2*b* of the lap siding with the bottom element to rest against. The stop is strong enough to allow proper placement of the two pieces of siding 2, 4 at the proper distance (as indicated by the front-side or outer face spacing 30 between the siding pieces) during installation. As described below in more detail, post-installation, as the siding pieces expand or elongate length-wise 200, the stop is pushed against and either moved, deflected or broken off 22 if expansion and/or elongation is large enough. In some embodiments, the stop element is configured to break off when the pair of siding panels expand.

As seen in FIGS. 1-5, the abutting lap siding products can be equal or approximately equal in thickness. In one exemplary embodiment, the lap siding panel total thickness ranges from ¼" to 1-¼", while the stop is located or is long enough to provide 1/16" to 1-½" spacing. The relative thicknesses of the bottom and top shiplap joint elements may vary, but as shown in the figures, together equal the lap siding panel thickness. In one embodiment, the bottom element shiplap thickness ranges from approximately 20% to approximately 80% of the lap siding panel thickness, while the top element shiplap thickness is equal to the lap siding panel thickness less the bottom element shiplap thickness (i.e., the corresponding bottom or top element comprises the remaining percentage of that thickness).

The stop can extend for the width of the siding or cladding, or only part of the width. For example, a line of periodic stops may extend across the width of the siding or cladding.

Figure 4:
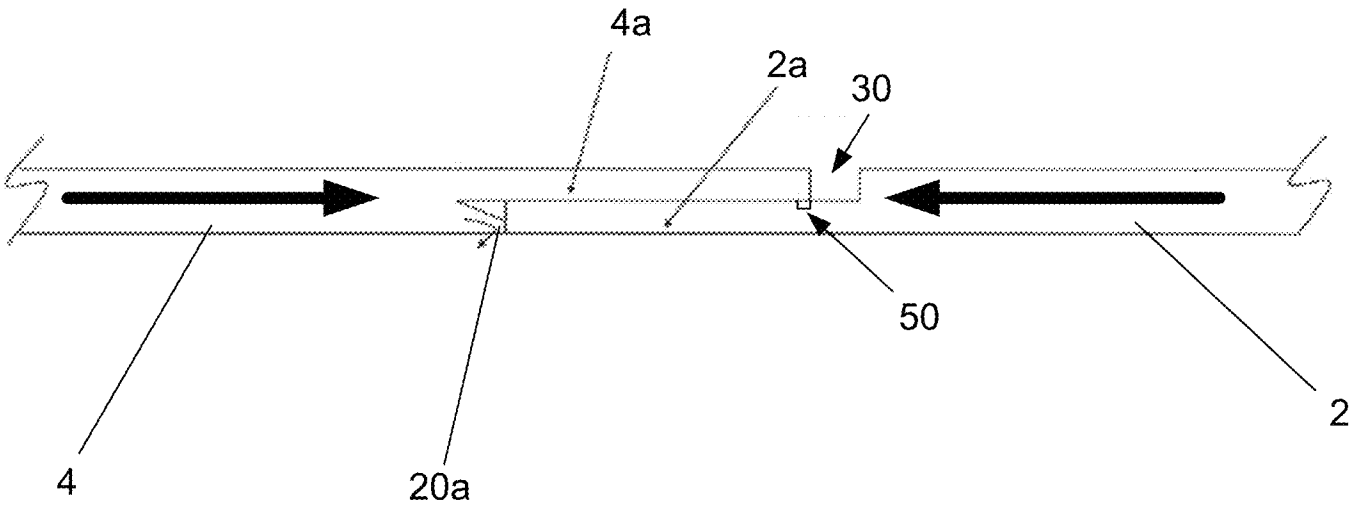
FIG. 4 shows a cross-section view of the lap siding product of FIG. 1 with an integrated water drainage channel and visual indexing line.

As seen in FIG. 4, a groove or channel 50 may be machined or cut into the outer/upper face of the bottom element (this feature can be used with any version of the stop). This groove or channel serves as an integrated water drainage channel helping to prevent water or moisture from migrating through the joint itself behind the siding panels (i.e., water traveling from the exterior migrates to the channel, where it then travels down the channel and out). As seen in FIG. 4, the groove or channel may be located appropriately to also serve as a visual indexing line for proper gapping of the siding panels during installation. The location of the groove or channel can be elsewhere on the face of the bottom element (or even on the underside of the top element) if use as a visual indexing line is not required.

Figure 5:
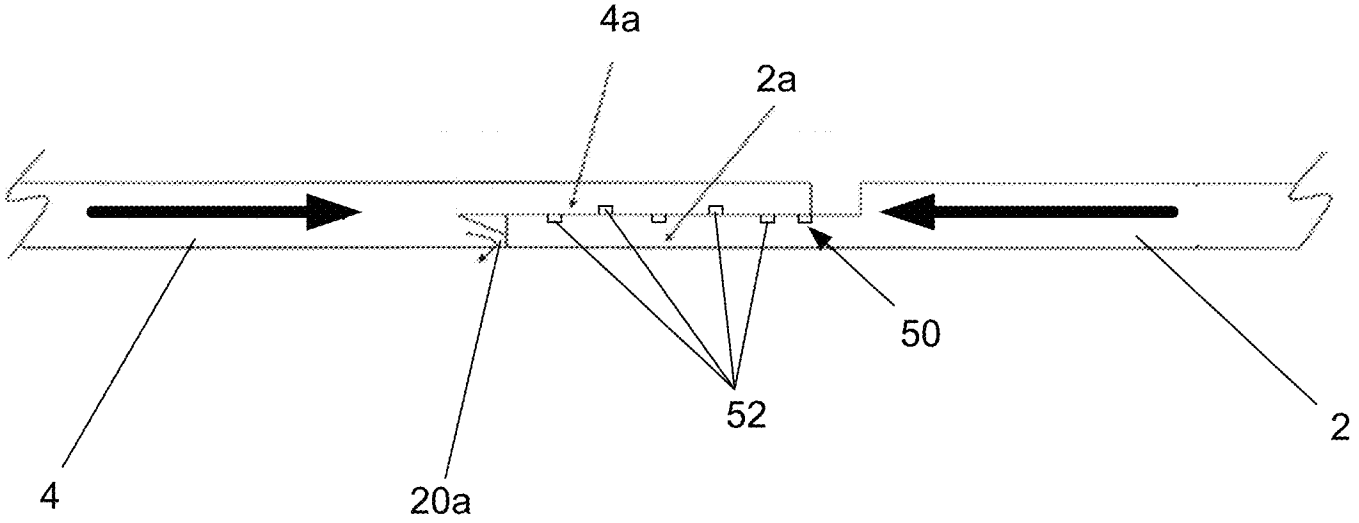
FIG. 5 shows a cross-section view of the lap siding product of FIG. 1 with integrated water drainage channels.
Figure 8:
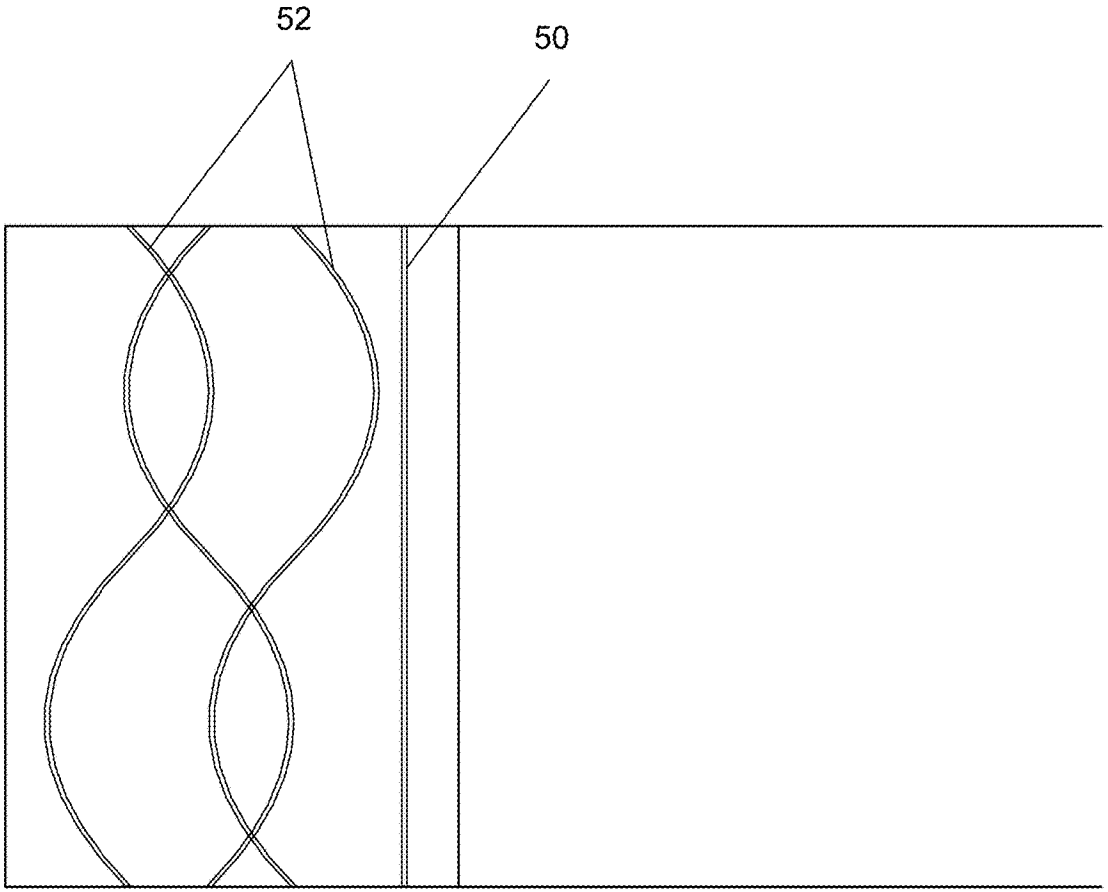
FIGS. 8 and 9 show a top view of grooves or channels in the outer/upper face of the bottom element.
Figure 9:
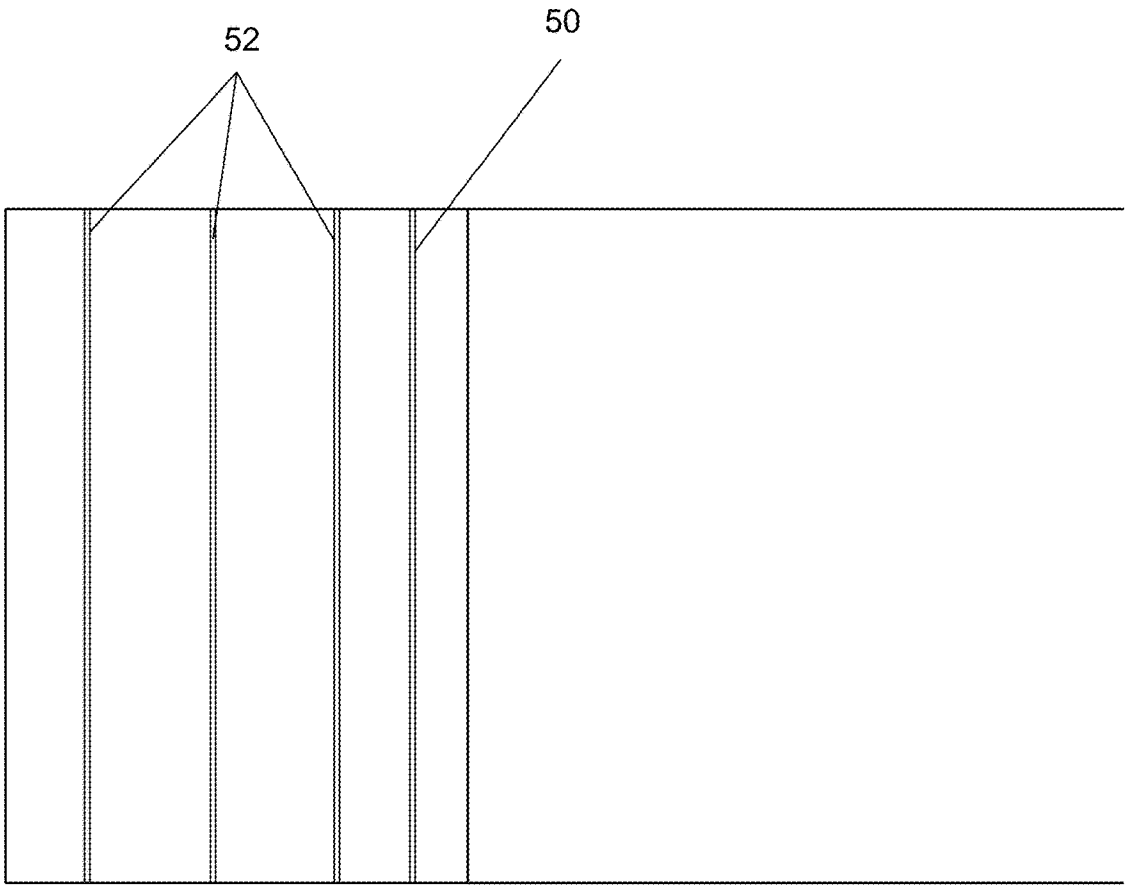

In several embodiments, as seen in FIG. 5, multiple grooves or channels 50, 52 may be provided. If multiples are provided, one may be positioned to serve as a visual indexing line, as described above. The groove(s) or channel (s) may be of any suitable size or configuration (e.g., ⅛" to 3⁄16" wide by up to ⅛" in depth, in the embodiment shown). They may extend straight across the width of the siding panel, or form a sine wave, alternating angles, or other patterns, as see in FIGS. 8 and 9. Where multiple grooves or channels are used, they may not intersect, or some or all may intersect to form various grids or patterns. They also may all be of the same size or configuration, or may vary (i.e., different widths and depths).

Figure 1:
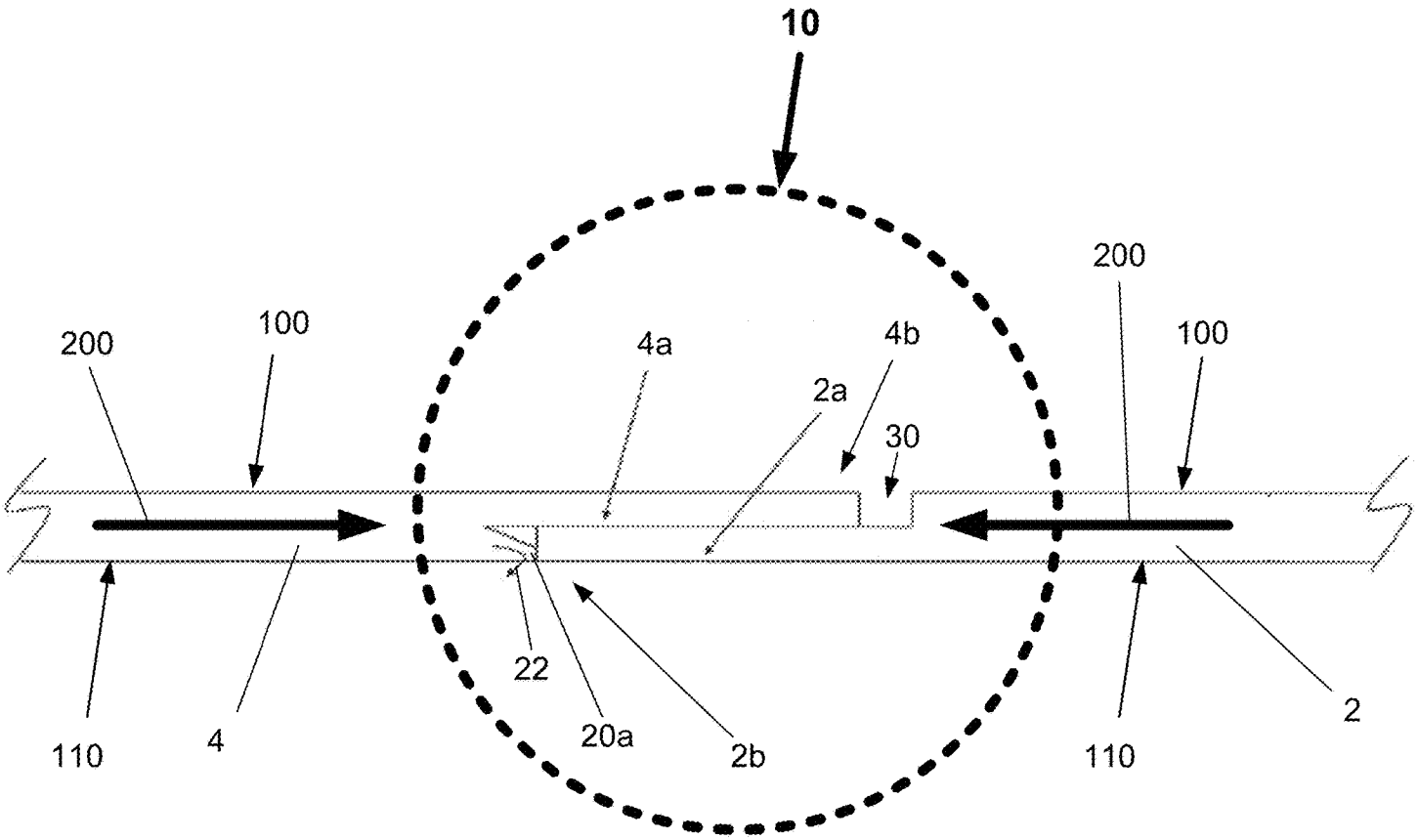
FIG. 1 shows a cross-section view of a lap siding product in accordance with an embodiment of the present invention.
Figure 2:
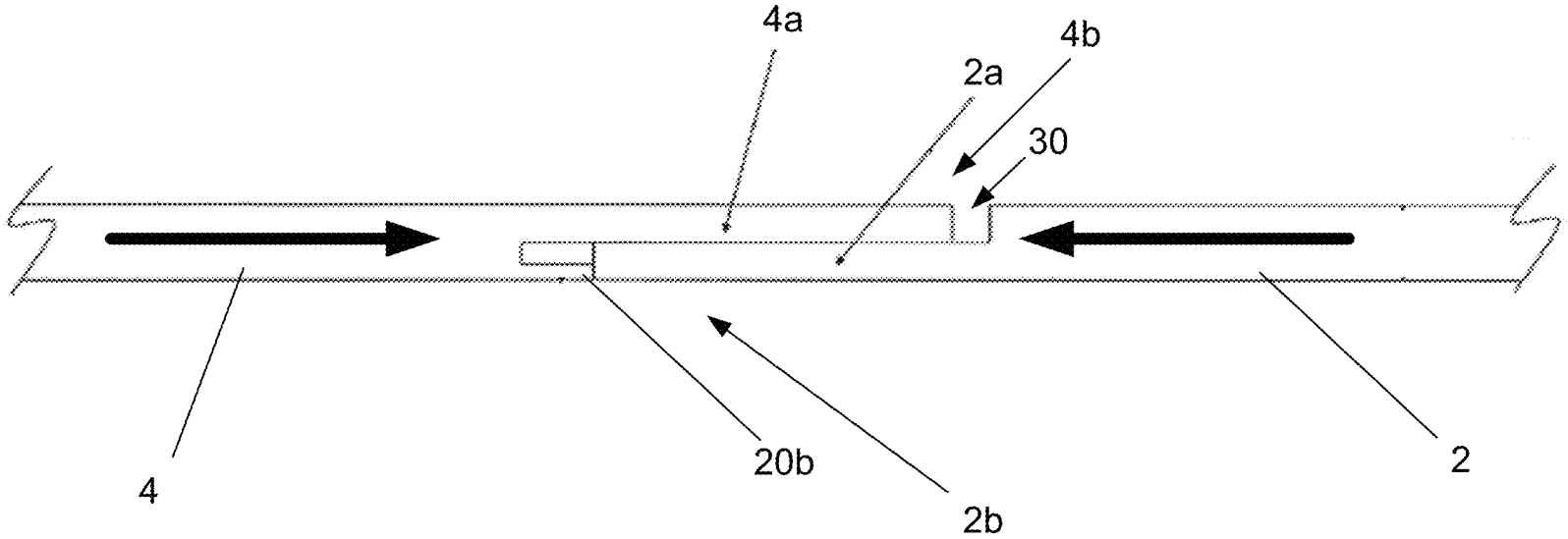
FIG. 2 shows another view of a lap siding product in accordance with another embodiment of the present invention.
Figure 6:
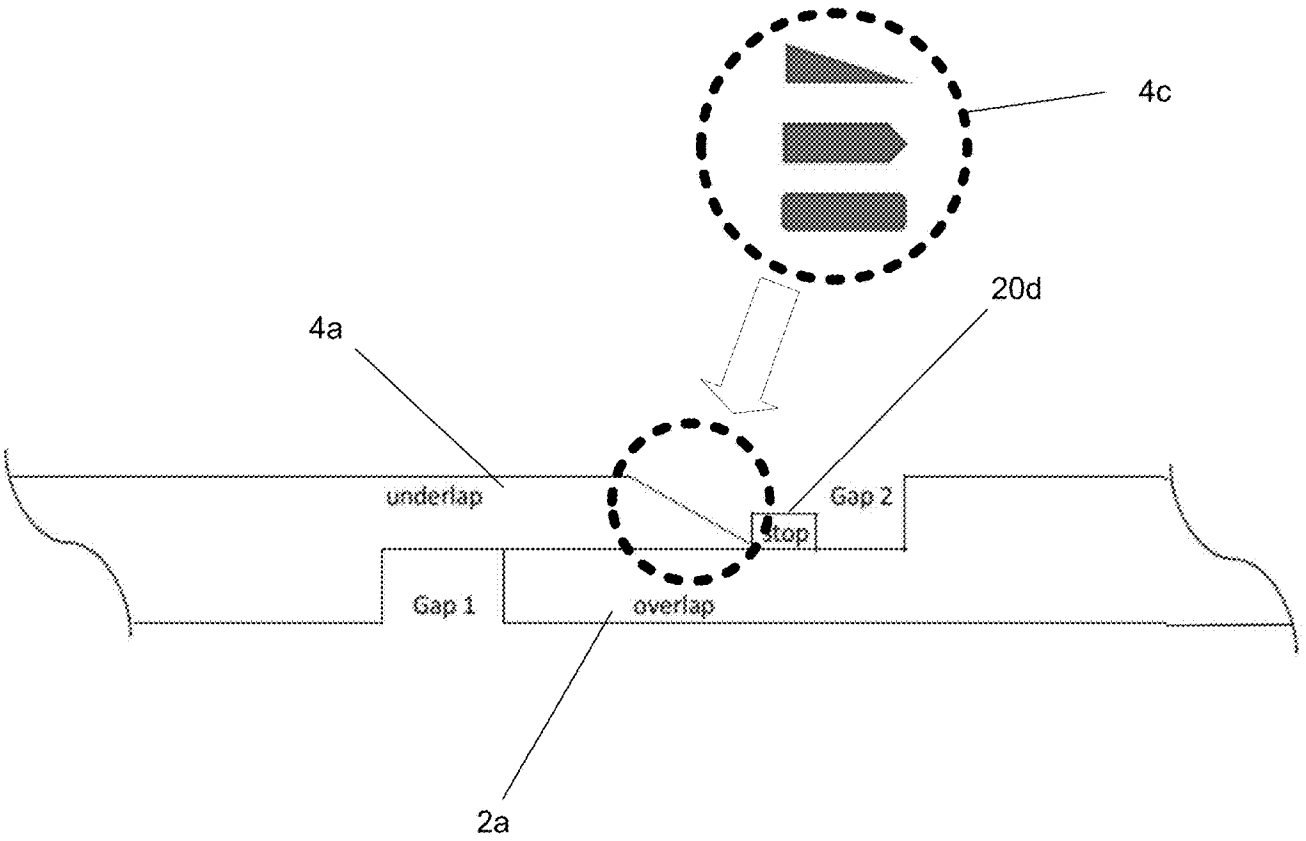
FIG. 6 shows a cross-section view of an alternative embodiment of a lap siding product with various leading edge profiles.
Figure 7:
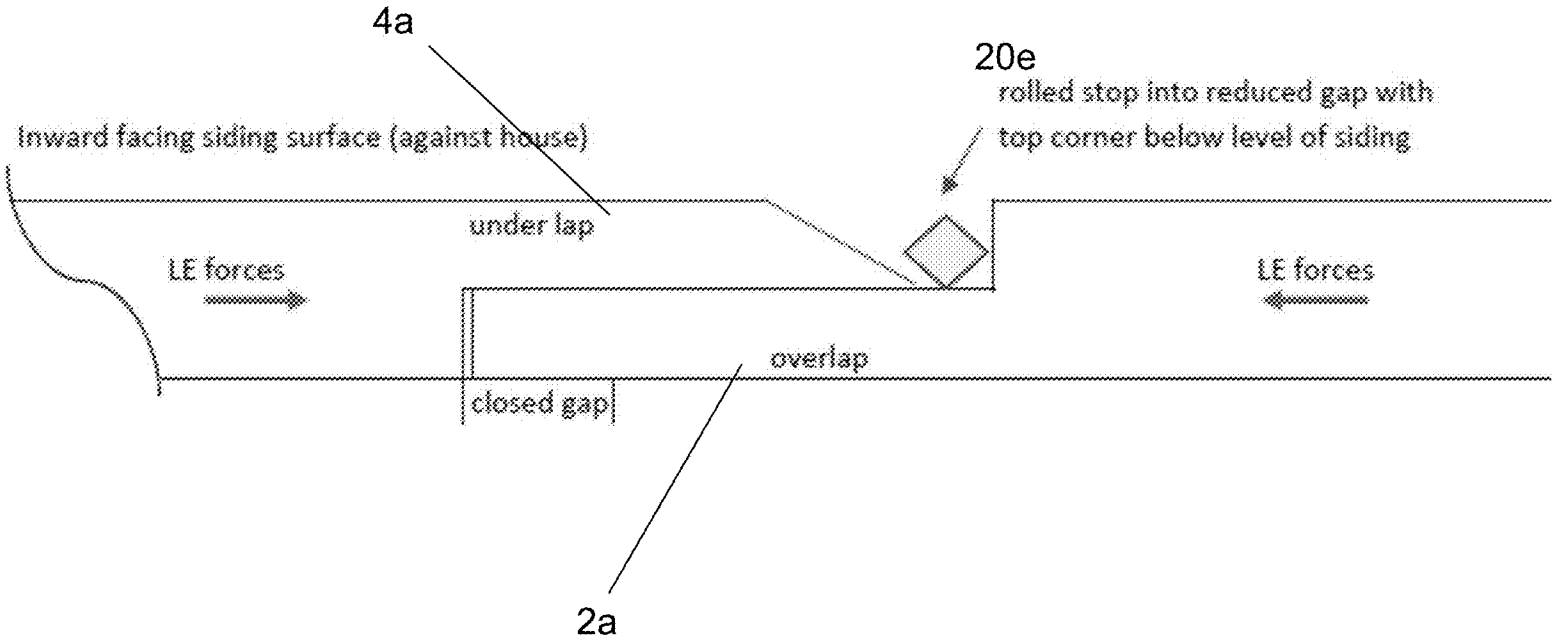
FIG. 7 shows a cross-section view of the lap siding product of FIG. 6 after expansion of the pieces of lap siding have caused the stop to be displaced.

FIG. 6 shows an alternative embodiment (a top view, inverted from the previous figures, so that the outward facing surface (outer) is on the bottom, and the inward facing surface (inner) face is on the top, where the gap (Gap 2) behind the stop 20*d* is wider than the stop itself, and the height of the stop 20*d* is lower than the plane of the corresponding inner face (i.e., less than the vertical depth of the corresponding joint element). It can also be seen that Gap 2 in this embodiment is wider than the gap (Gap 1) on the outer face. This arrangement provides space for the stop to be pushed or rolled into the adjacent gap, if the stop does not fall vertically out of the gap. As seen in FIG. 7, as linear expansion (LE) forces cause the stop 20*e* to roll (in this case, approximately 90 degrees) into the adjacent gap (Gap 2), there is room to accommodate the stop without causing further or lateral distortion of the joint. As seen, Gap 1 has largely closely at this point. In this particular embodiment, the length of the diagonal from opposite corners should also be less than the vertical depth, so that a corner of the rolled stop stays below the plane of the corresponding inner face. The leading edge 4*c* of the underlap joint may be square-edged, as seen in FIG. 1, or tapered (single or double tapered to a point, with the point knife-edged or blunted) or rounded (e.g., bull-nosed), as seen in FIG. 6.

After installation, as the pieces of siding expand or contract upon exposure to various weather conditions, the siding panels often will expand or elongate length-wise. In a prior art joint, this expansion would often lead to buckling or distortion in the siding panels, and in the joints. With the present invention, the stop is pushed against and either moved, deflected or broken off if expansion and/or elongation is large enough, thereby allowing expanding or elongation in the pieces of siding through the joint without resulting or causing buckling or distortion in the siding panels themselves or in their joints.

The present invention also eliminates the need for caulk, pan flashing or joint covers in the joint between the pieces of siding or cladding, as the design of the joint addresses weather-relation buckling and expansion and water intrusion. The shape of the joint reduces the intrusion of water, and re-directs water down and out from behind the siding.

The siding or cladding may be manufactured from a variety of materials utilized for such purposes, including, but not limited to, wood, engineered wood composites, and cellulose fiber cement.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A lap siding system, comprising:

a pair of lap siding panels, each panel comprising an outer face, an inner face, a first end with a recess cut with a first recess face parallel to and open to the inner face, and a second end with a recess cut with a second recess face parallel to and open to the outer face, wherein the first end of one panel is configured to meet with and form a shiplap joint with the second end of the other panel;

further wherein the second end comprises one or more drainage grooves extending laterally across the second recess face, wherein the one or more drainage grooves extend into the second recess face with a bottom below the second recess face and a top level with the second recess face, wherein the top is closer to the outer face of the panel than the bottom, and the bottom is closer to the inner face of the panel than the top;

further wherein a first one of said one or more drainage grooves is configured to position a corresponding first end at a first pre-determined outer face spacing distance when forming the shiplap joint.

2. The lap siding system of claim 1, wherein the first end of each panel comprises a top shiplap joint element, and the second end of each panel comprises a bottom shiplap joint element, wherein the top shiplap joint element overlaps in whole or in part the corresponding bottom shiplap joint element when forming the shiplap joint.

3. The lap siding system of claim 2, wherein the top shiplap joint element and the bottom shiplap joint element are equal in thickness.

4. The lap siding system of claim 2, wherein the top shiplap joint element is thicker than the bottom shiplap joint element.

5. The lap siding system of claim 2, wherein the top shiplap joint element is thinner than the bottom shiplap joint element.

6. The lap siding system of claim 1, further wherein there are at least two of said drainage grooves, where a second one of said drainage grooves is configured to position the corresponding first end at a second pre-determined outer face spacing distance different from the first pre-determined outer face spacing distance when forming the shiplap joint.

7. The lap siding system of claim 1, wherein at least one of said one or more drainage grooves extends laterally straight across the second recess face.

8. The lap siding system of claim 1, wherein at least one of said one or more drainage grooves is curved for at least a portion of its length.

9. The lap siding system of claim 1, wherein at least two of said one or more drainage grooves intersect.

10. The lap siding system of claim 1, wherein the first end comprises a tab extending outward from the first recess face configured to position a corresponding second end at the first pre-determined outer face spacing distance when forming the shiplap joint, wherein the tab is configured to shear off when the pair of panels expand linearly.

11. The lap siding system of claim 10, further wherein said first end recess cut comprises a vertical recess face orthogonal to the inner face, with a height; and further wherein the tab comprises a height and width, and the height of the tab is less than the height of the vertical recess face of the first end recess cut.

12. A lap siding system, comprising:

a pair of lap siding panels, each panel comprising an outer face, an inner face, a first end with a recess cut with a first recess face parallel to and open to the inner face, and a second end with a recess cut with a second recess face parallel to and open to the outer face, wherein the first end of one panel is configured to meet with and form a shiplap joint with the second end of the other panel;

wherein the second end comprises one or more drainage grooves extending laterally across the second recess face;

wherein at least one of said one or more drainage grooves is configured to position a corresponding first end at a first pre-determined outer face spacing distance when forming the shiplap joint; and wherein the first end comprises a tab extending outward from the first recess face configured to position a corresponding second end at the first pre-determined outer face spacing distance when forming the shiplap joint, wherein the tab is configured to shear off when the pair of panels expand linearly.

13. The lap siding system of claim 12, further wherein said first end recess cut comprises a vertical recess face orthogonal to the inner face, with a height; and further wherein the tab comprises a height and width, and the height of the tab is less than the height of the vertical recess face of the first end recess cut.

* * * * *